United States Patent [19]

Foster, Sr.

[11] 4,102,058

[45] Jul. 25, 1978

[54] FABRIC FINISHING MACHINE

[76] Inventor: Lloyd Foster, Sr., Chopmist Hill Rd., Box 61, Chepachet, R.I. 02814

[21] Appl. No.: 828,928

[22] Filed: Aug. 29, 1977

Related U.S. Application Data

[63] Continuation-in-part of Ser. No. 779,624, Mar. 21, 1977, abandoned, which is a continuation-in-part of Ser. No. 650,846, Jan. 21, 1976, abandoned.

[51] Int. Cl.[2] ..... F26B 13/00

[52] U.S. Cl. ..... 34/155; 34/24; 34/33

[58] Field of Search ..... 34/24, 33, 117, 120, 34/155, 160; 26/92; 101/416 R, 416 A

[56] References Cited

U.S. PATENT DOCUMENTS

| | | | |
|---|---|---|---|
| 1,129,155 | 2/1915 | Woodsome | 34/114 |
| 1,838,480 | 12/1931 | Gangler | 34/155 |
| 2,001,322 | 5/1935 | Burns et al. | 34/155 X |
| 2,559,420 | 7/1951 | Frenkel | 34/155 X |
| 2,624,573 | 1/1953 | Rice | 34/155 |

*Primary Examiner*—John J. Camby
*Attorney, Agent, or Firm*—Barlow & Barlow

[57] ABSTRACT

A finishing machine for drying a fabric web, as it comes from a printing or other processing machine, which includes the guiding of the web so as to reverse the web from front face to back face so that the back of the web and not the printed face will contact the guiding surface about which it travels. Also the use of this reversal of face and back in a drying machine where the fabric web travels in an inward and outward spiral one within the other to reduce the floor space the drying machine occupies.

14 Claims, 7 Drawing Figures

FABRIC FINISHING MACHINE

CROSS REFERENCE TO RELATED APPLICATIONS

This application is a continuation-in-part of my earlier filed applications, Ser. No. 779,624 filed Mar. 21, 1977, now abandoned, which was a continuation-in-part of Ser. No. 650,846 filed Jan. 21, 1976, now abandoned.

BACKGROUND OF THE INVENTION

In finishing a fabric web, the web may be passed through a padder, a dryer, a cure box, about cooling cans containing water, a washer, and another finish dryer. The temperature is varied in all and/or any of the above machines at any time and for various reasons. in printing the web is printed, then passed through an ager to develop the color, a washer, a dryer, and a finisher.

In the drying of a printed fabric web, should the printed side of the web contact the guiding rollers or drums, there is often deposited some of the printing ink on the rollers or drums which will discolor other portions of the fabric and cause seconds to be formed.

SUMMARY OF THE INVENTION

In a dryer or about cooling cans, a group of guide rolls, some of which are diagonal to the path of travel and also to other guide rolls, are arranged to cause a fabric web when properly lead thereover to reverse the front face and back face of the web so that the back face and not the front face will contact the guiding surfaces for the passage of the fabric web in a finishing process. Utilization of this reversal of faces of the fabric web is had in a drying machine which has a plurality of rolls or drums located between pairs of arms radiating from a generally central point over which the fabric web may be passed by contacting alternate rolls in the radial location of the rolls and leading the fabric in a generally inward spiral to a generally central point and then by passing the fabric over diagonally arranged rolls always with the back of the fabric against the rolls, the printed surface and back of the fabric are reversed and the fabric web is led in an outward spiral out of the drying machine in between the paths of the inward spiral of the web and while passing in these two spiral directions, the fabric web is treated with a gas, such as air or any other gas, to dry the fabric while maintaining the back of the fabric always in contact with the guiding surface. In some cases instead of rolls there may be drums heated with steam or hot air to apply heat to the fabric for drying it. In some cases cooling cans containing water may be used. In many cases the guiding surfaces are driven so that there will be less tension on the fabric web as it is moved through the drying machine.

DESCRIPTION OF THE PREFERRED EMBODIMENTS

Figure 1:
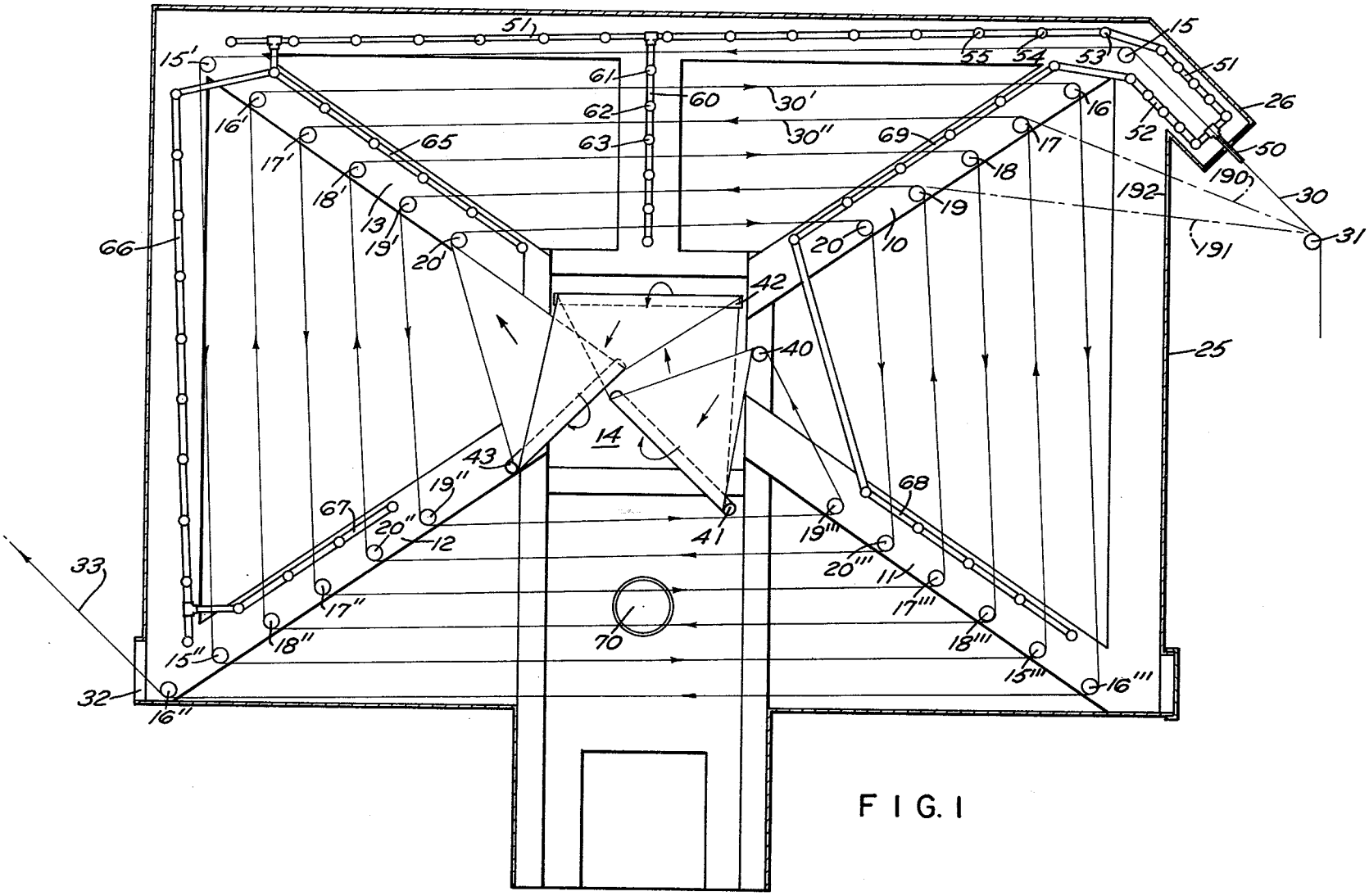
FIG. 1 is an elevation in section and somewhat diagrammatic of the machine arranged with rolls for the guiding surfaces of the fabric.

FIG. 1 is somewhat diagrammatic and illustrates arms designated 10, 11, 12 and 13 as generally radiating from a central location 14. There are duplicate arms parallel to and spaced from these arms 10 to 13 also radiating from the central location 14. Between these pairs of arms, rolls are supported on ball bearings and are located as shown in FIG. 1 as radiating from the central point. Thus between the pair of arms 10 there are rolls 15, 16, 17, 18, 19 and 20, and similar rolls are located between each of these pairs of arms as indicated in FIG. 1 with similar numbers with a prime, double prime or triple prime added. An enclosure designated generally 25 encloses all of these arms so that the heated drying gases may be more effective in acting upon the fabric or cloth web. As an entrance to this closure 25 there is a tubular slot 26 (FIG. 1) though which the fabric web designated generally 30 may pass by being guided over the rod or guiding surface 31. This web is fabric as it enters the chamber in which these rolls are located passes over roll 15 on arms 10 and then over roll 15' on arms 13, then over roll 15'' on arms 12, and then over roll 15''' on arms 11 and then over roll 17 on arms 10 for the first inward cycle, then over roll 17' on arms 13, 17'' on arms 12, and 17''' on arms 11, and then over roll 19 on arms 10 for the second inward cycle and then over roll 19' on arms 13, 19'' on arms 12, 19''' on arms 11 and then about a directing roll 40 for its third inward cycle and then to a group of rolls to reverse its front face and back face by first passing over the top of roll 41 and then under roll 41 which is at an angle of about 45° to the plane of the axis of rolls 40 and 42, thence under roll 42 and over this roll to roll 43 where it passes over and then under this roll 43 at about 45° to the plane of axis 40 and 42 and at 90° to the axis of roll 41 and then to roll 20' on arms 13 where its back is then to this roll 20' with its face away from the roll, then about roll 20 on arms 10, then about roll 20''' on arms 11, then about roll 20'' on arms 12, then to roll 18' on arms 13 for its first outward cycle, then to roll 18 on arms 10, then to roll 18''' on arms 11, then to roll 18'' on arms 12 and then to roll 16' on arms 13 for its second outward cycle, and then to roll 16 on arms 10, then to roll 16''' on arms 11, and to roll 16'' on arms 12 and then out of the machine through opening 32 in casing 25 as at 33.

In order to supply drying gas at various locations against the fabric web passing in this inward and outward spiral, a conduit for gas or air 50 extends inwardly through the slot 26 with branches at 51 and 52 to connect with distributing tubes designated generally 53, 54, 55, and so forth, extending widthwise of the fabric web and having spaced outlets for the drying air to impinge against the stretches of fabric web as it is passed along. These tubes in the branch 51 also extend inwardly radially of the general arrangement as at 60 with spaced lateral tubes such as 61, 62, 63, and so forth, extending widthwise of the fabric web and also provided with openings top and bottom to impinge air against the opposite stretches of fabric which are now designated as 30' and 30'', for example in the upper part of the machine, this being duplicated between each of the runs of fabric web, one of which runs of web is the ingoing spiral and the other is the outgoing spiral of the travel of the cloth of web. Other branches of the drying air are shown at 65, 66, 67 from branch 51 while from the branch 52 there are conduits 68 and 69 with similar discharge laterally extending conduits.

In addition, drying air may be directed inwardly through the conduit 70 from some standard drying apparatus usually constituting an inlet for air to a closed chamber with a fan to suck the air in and drive it out through a radiator or some heated means known in the art and then through conduit 70 into casing 25.

Figure 2:
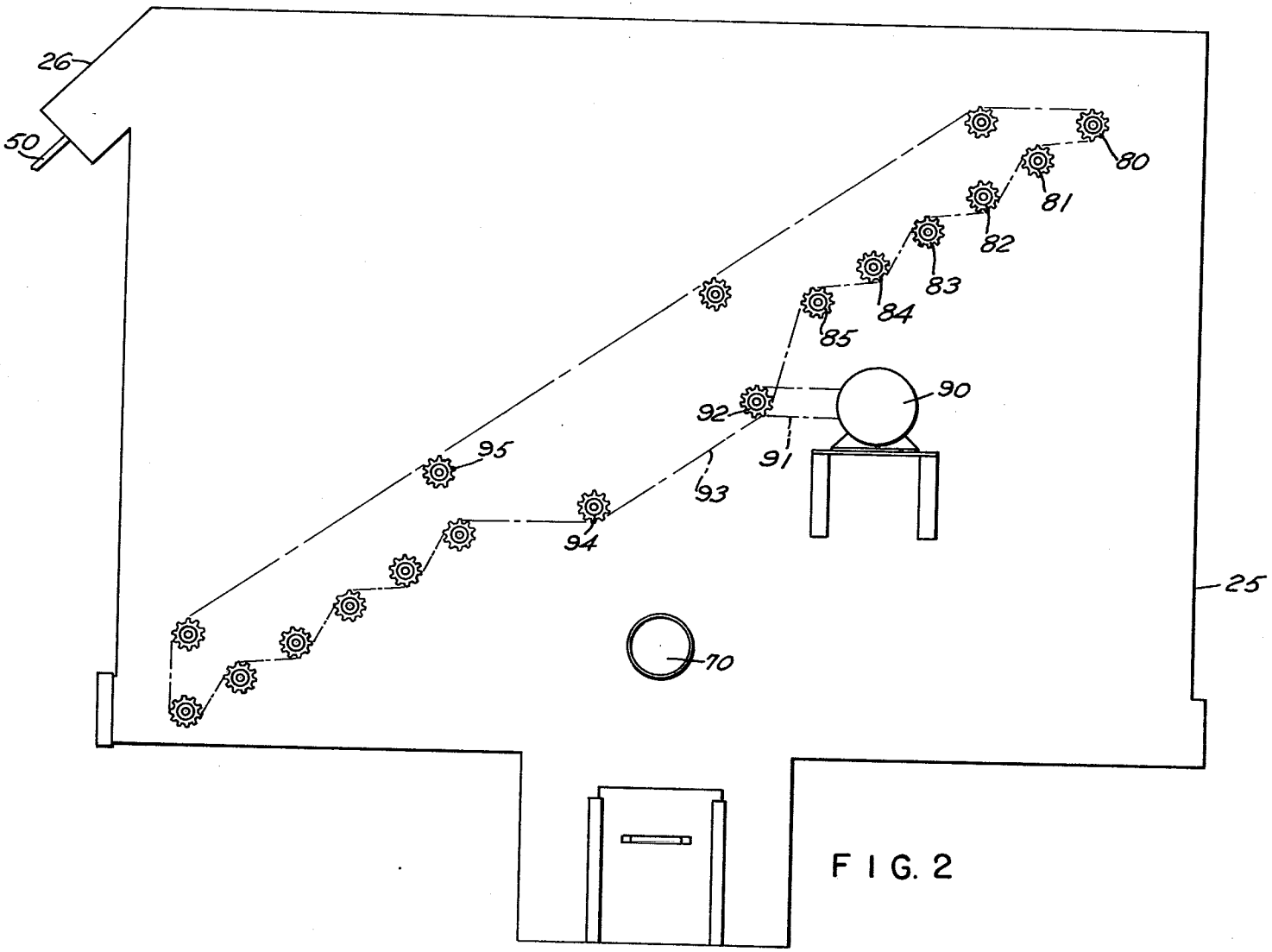
FIG. 2 is an end view illustrating the drive for the rolls as shown in FIG. 1.

A drive for the rolls indicated at 15 to 20 and 15' to 20', and so forth, comprises the shaft of the roll extending out through an end of the casing 25 and each being provided with a gear such as designated at 80, 81, 82, 83, 84 and 85 (FIG. 2) which may be for the rolls on arms 10 and a similar set of gears for the rolls on the opposite arms 12. A motor 90 has a chain 91 driving a shaft on which gear 92 is mounted which gear 92 drives the chain 93 which extends about the gears 80 to 85 on arms 10 and the corresponding gears of the arms 12 with suitable idlers such as 94, 95, and so forth, to support the chain and direct its path of movement. idlers such as 94 may be adjustably mounted for the proper tension on the chain.

In some cases instead of the use of rolls such as designated 15 to 20, 15' to 20', 15'' to 20'', 15''' to 20''', drying cans (FIG. 3) may be utilzied designated as 100, 101, 102, 103, 104, 105 which will be hollow and will be heated by steam or hot air from a suitable manifold with a conduit leading to each of the drums, and this applies also to the drums located and supported by arms 10', 11', 12' and 13'. This heating will be from one end of the drums while the other end of the drums will be provided with a shaft which will extend outwardly at the other end and each of these shafts will be provided with a sprocket gear such as 110 and a chain such as a sprocket chain 111 will be passed over these gears and about sprockets from sprocket 110 to 112 thence 113, 114, 115, 116, 117, 118, 119, 120, 121, 122, 123, 124, 125, 126, 127, 128, 129, 130, 131, 132, 133, 134, 135, 136, 137, the latter of which is on a shaft driven by a hidden gear by chain 138 from variable speed drive 139 which is driven by chain 140 from motor 141 so as to drive them in the proper direction for the passage of the web of fabric 145 over the drums in an inward spiral where a reverse or front for back face of the fabric will occur about roll 40–43 similar to that described above and then through an outward spiral in between the paths of the inward spiral to be passed from the machine.

Figures 3, 3A, 3B:
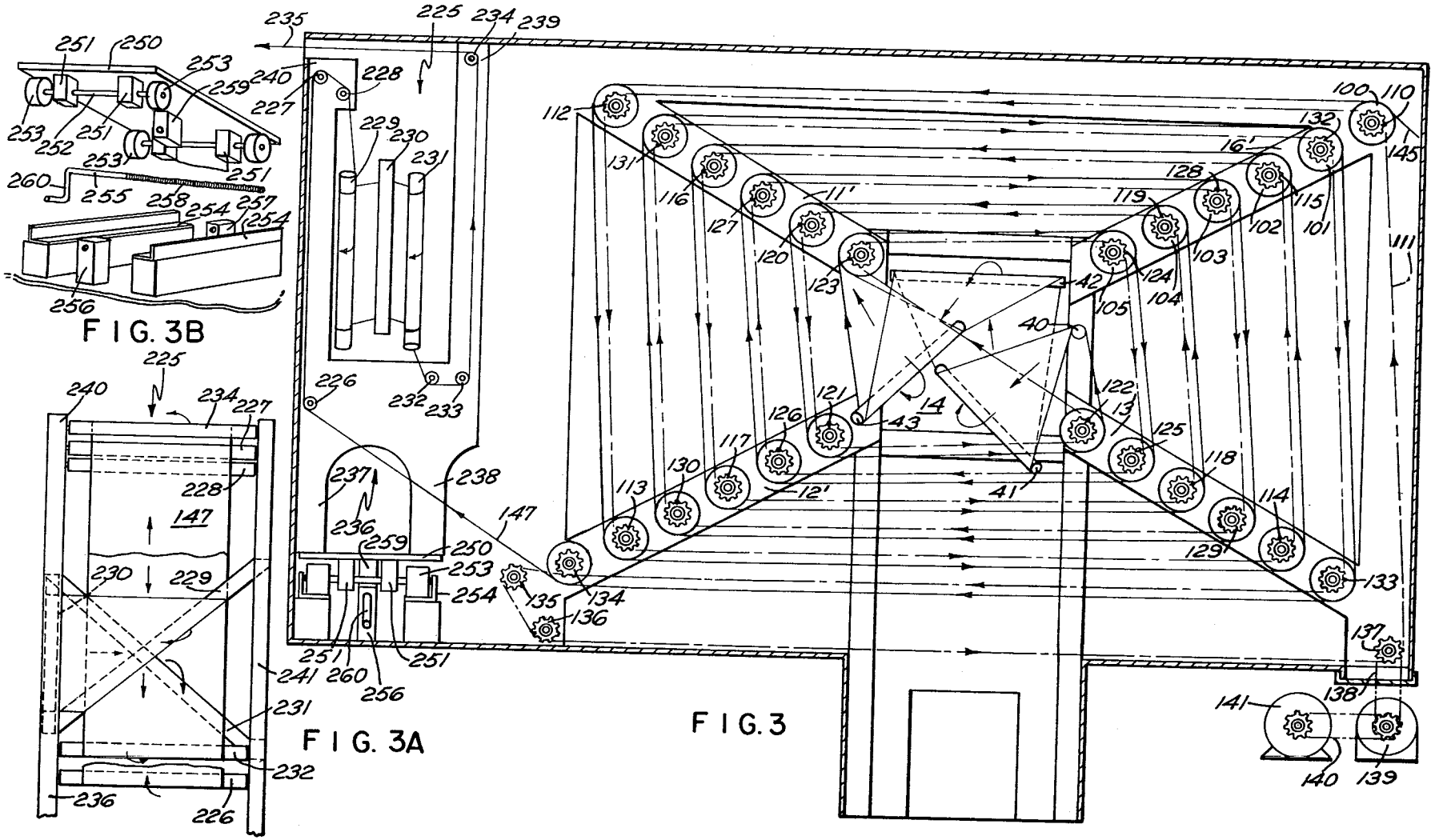
FIG. 3 is an elevational view similar to FIG. 1 but illustrating heated cans or drums instead of rolls with a drive therefor.
FIG. 3A is an elevation of a fragmental portion of the reversing rolls of FIG. 3.
FIG. 3B is a fragmental perspective view of the mounting of the reversing rolls of FIG. 3.

In some cases it is desirable to reverse the fabric from face to back such as would occur between a drying apparatus and a curing box or heat setting apparatus, and in FIG. 3 there is shown fabric 147 as leaving the drying cans and threaded into an upright reversing apparatus designated generally 225. The fabric 147 has its face down as it leaves the cans and is directed beneath the group of reversing rolls over a bar or roll 226, then upwardly about two guiding rolls 227 and 228 and then downwardly to pass about the first diagonal roll 229 with its back to this roll, as shown by the arrow, and then about a generally vertical roll 230 with its back to this roll, and then about oppositely positioned diagonal roll 231 with its back to this roll, and then downwardly about guide roll 232 with its back to this roll, then about other guide rolls 233 and 234 with its back to these rolls and then out of the machine as shown at 235 with its face upwardly being reversed from the face downwardly as it leaves the machine. These rolls are supported by a framework designated generally 236 comprising spaced uprights each having a pair of legs 237 and 238 with portions 239 and 240 extending upwardly with connecting cross bars. In FIG. 3 the nearest of these two stands (in FIG. 3A) is removed (in FIG. 3) for clarity. This stand is shown in FIG. 3A looking at the reversing apparatus from the left as shown in FIG. 3. Here the stand 236 is at the left and the removed stand 241 is at the right and shows the support for the diagonal rolls or bars 229 and 231. This entire stand 236, 241 is mounted for lateral movement if the fabric as it comes from the drying cans at 147 for alignment purposes, and the legs 237 and 238 are mounted on a platform 250 which in turn is supported through bearings 251 and a shaft 252 with wheels at either end as at 253. These wheels roll along a spaced pair of angle iron tracke 254, there being two sets of shafts and wheels for supporting the platform 250 as may be readily seen in FIG. 3B. A shaft 255 is mounted in fixed bearings 256 and 257 on the housing or chamber and is threaded as at 258 and passes through a nut or thread member 259 fixed on the platform 250 so that when this shaft is rotated such as by crank 260, the platform 250 supporting the reversing rolls 225 may be moved laterally for alignment in handling the web of fabric as it emerges at 147 from the cans and is discharged as at 235.

The group of rolls in the center of the inner spiral of the drying device shown herein are likewise adjustable laterally by a device similar to that just above described, although in the drawing it is omitted for clarity.

Figure 4:
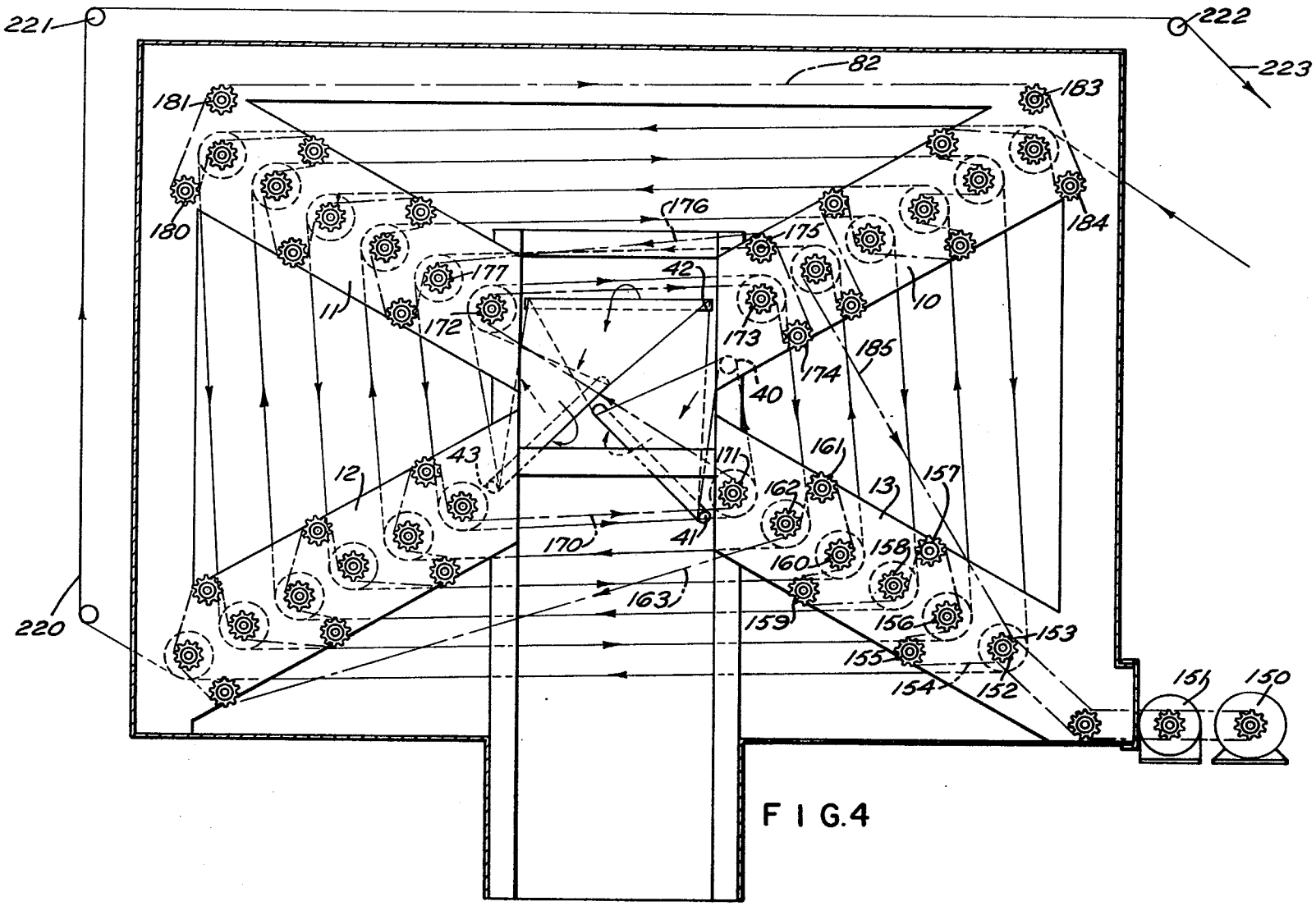
FIG. 4 is similar to FIG. 3 with an alternate drive.

Another way of reversing the face and back of the web as in FIG. 4 is to carry the web right over the machine where web 220 will pass about roll 221 and 222 and the end emerges at the side of the machine at 223 where it entered.

In some cases if a shorter drying path is desired the fabric web 30 after being guided over bar 31 may be led to roll 17 as at 190 or to roll 19 as at 191 through an opening 192 in casing 25.

In the drive shown for FIG. 3, the length of chain about the sprocket gears extends from one arm such as 10 to another arm such as 11, etc., about the different gears along each of the arms. However, there are occasions where parallel chains in this manner would be inconvenient, and thus in FIG. 4 there is an alternative drive in which the motor 150 thru a variable speed drive 151 drives a gear at 152 with a parallel gear 153 on the same shaft of this outermost drum. The chain 154 then leads about an idler gear 155 to gear 156 and thence about idler gear 157 to sprocket gear 158, thence to idler 159, sprocket 160, idler 161, sprocket 162, with the chain driving each of its adjacent sprocket gears along the length of one of the arms and then the chain extends as at 163 from arm 13 to arm 12 about similar gears and idlers on adjacent arm 12 and about sprocket gears for reversing the direction of the drive by means of idlers as just described for this arm 13 and thence it is led by a length of chain 170 to the sprocket gear 171 on arm 13, thence about sprocket 172 on arm 11 to sprocket 173 on arm 10 thence by idler 174 and 175 and chain 176 about sprocket 177 on arm 11 and thence by sprocket gears and idlers on arm 11 to idlers 180, 181, chain 182 and then idlers 183, 184 to sprockets and idlers on arm 10 and then by chain 185 back to sprocket 153.

Figure 5:
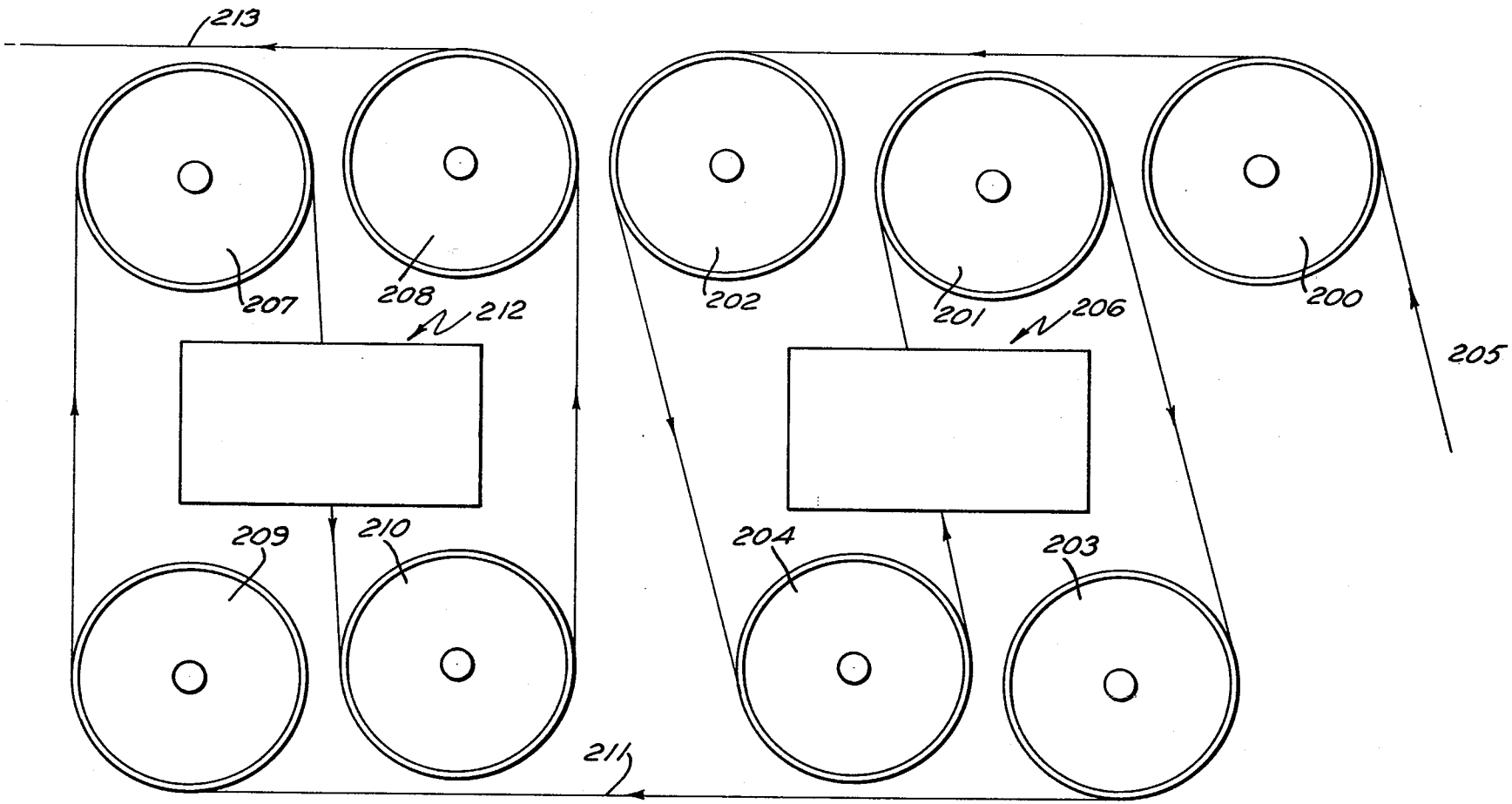
FIG. 5 is a schematic end elevation of an alternate arrangement of drums.

In some cases instead of the utilization of inward and outward spirals, there may be as shown in FIG. 5 a series of upper heated drums such as 200, 201, 202 and lower drums 203, 204. The fabric web 205 may be led as shown in the drawing (FIG. 5) by the arrows there shown about drum 200, then 202, then 204, into the reversing center 206 as shown in FIG. 1 with the back of each fabric web to each of the cans or drums and then after reversal of the front face and the back face by means of the reversing apparatus 206, it is led out about drum 201 and 203, again with its back to the drums. If further drying is desired, another set of drums 207, 208, 209 and 210 may be utilized, and as the fabric now designated 211 comes from the first group of drying cans, it would pass about drum 209 and then 207 to a reversing mechanism 212 as above described where the face and back are interchanged and then the fabric web may pass about drum 210 and 208 and thence out of the machine as at 213.

I claim:

1. In a fabric finishing machine a group of rolls over which the fabric web is lead comprising means for directing the incoming fabric web to said group of rolls, a first roll at an angle to the direction of feed of the incoming web about which the web is lead with its back to said roll, a second roll with its axis at an angle to the first roll about which the web is lead with its back to said second roll, and a third roll with its axis at an angle to the first and second rolls and not parallel to either about which the web is lead with its back to the said third roll to reverse the face and back of the fabric web as it enters and leaves the group of rolls.

2. In a fabric finishing machine as in claim 1 wherein the axis of the first and third rolls are at generally right angles to each other.

3. In a fabric finishing machine as in claim 1 wherein the axis of the second roll is at generally 45° to the axis of its adjacent roll in the path of the fabric web travel.

4. In a fabric finishing machine as in claim 1 wherein the fabric passes beneath the group of rolls and is then directed into the group passes

5. In a fabric finishing machine as in claim 1 wherein the group of rolls is movable laterally of the general direction of the fabric which pases thereover.

6. A fabric finishing machine comprising a plurality of fabric web guiding surfaces, means for supporting said surfaces at different radial distances from a center point and over radial alternate of which surfaces a fabric web may be guided in generally an inward spiral direction from the outside toward its center, guiding means at the center portion of said surfaces at the terminating of said inward spiral for reversing face for back the fabric web when drawn thereover, said web being then guided in the opposite direction over radial alternate of said guiding surfaces in a reverse outward spiral between the stretches of the web of the inward spiral whereby the same back surface of the cloth web will contact the guiding surfaces in both inward and outward spiral travel.

7. A fabric finishing machine as in claim 6 wherein means are located between said runs of web to impinge gas against said web.

8. A fabric finishing machine as in claim 6 wherein means are located beween said runs of web to impinge gas against said web on both back and front sides of the web simultaneously.

9. A fabric finishing machine as in claim 6 wherein some of said guiding surfaces are rolls driven to assist movement of the web with alternate radially arranged surfaces driven in opposite directions.

10. A fabric finishing machine as in claim 6 wherein some of said guiding surfaces are heated drums.

11. A fabric finishing machine as in claim 6 wherein some of said guiding surfaces are heated drums which move with the web as it is drawn thereover.

12. A fabric finishing machine as in claim 6 wherein said guiding surfaces are supported by pairs of arms radiating from a general central point.

13. A fabric finishing machine as in claim 6 wherein some of said guiding surfaces are heated drums, said drums being rotatively driven by sprockets and a chain with the chain extending from the sprockets of the drum on one arm to the sprockets on the drums on an adjacent arm.

14. A fabric finishing machine as in claim 6 wherein some of said guiding surfaces are heated drums, said drums being rotatively driven by sprockets and a chain with the chain extending from the sprockets on one arm to the next sprocket on the same arm about a reversing idler sprocket.

* * * * *